United States Patent [19]

Mann

[11] 4,146,284

[45] Mar. 27, 1979

[54] CONNECTIVE ELECTRICAL WIRING ELEMENT FOR MINIATURE BUILDINGS

[76] Inventor: Wayne O. Mann, 308 Broadway, Union Beach, N.J. 07735

[21] Appl. No.: 740,131

[22] Filed: Nov. 8, 1976

[51] Int. Cl.[2] ..... H01R 9/00

[52] U.S. Cl. ..... 339/20; 339/23

[58] Field of Search ..... 52/221; 339/20, 21 R, 339/22 R, 23; 35/19 A; 46/12, 13, 19–21, 45, 226, 228; 312/223

[56] References Cited

U.S. PATENT DOCUMENTS

| | | | |
|---|---|---|---|
| 1,889,468 | 11/1932 | Flannery | 46/12 |
| 2,040,974 | 5/1936 | Bigelow | 46/12 |
| 2,267,080 | 12/1941 | Clayton | 339/23 |
| 2,312,580 | 3/1943 | O'Brien | 339/23 |
| 2,544,034 | 3/1951 | Levering | 46/12 |
| 3,664,055 | 5/1972 | Bass et al. | 46/45 |
| 4,017,130 | 4/1977 | Hanson | 312/223 |

OTHER PUBLICATIONS

National Electric Products Catalog, 1938, pp. 42, 46.

The Complete Bood of Making Miniatures, Newman et al., pp. 72–87, 1975.

*Primary Examiner*—Gerald A. Dost

*Attorney, Agent, or Firm*—Stephen W. White

[57] ABSTRACT

A connective electrical wiring element particularly useful in providing the wiring for miniature buildings (e.g. doll houses) is described. This element permits the user to connect electrical fixtures, appliances, lights, and the like in a facile manner while at the same time providing integral construction portions of the building. The wiring elements are decorative as well as functional.

8 Claims, 4 Drawing Figures

CONNECTIVE ELECTRICAL WIRING ELEMENT FOR MINIATURE BUILDINGS

BACKGROUND OF THE INVENTION

1. Field of the Invention:

This invention relates to the construction of miniature buildings and more particularly to elements which will provide the necessary electrical wiring of these buildings. Still more particularly, this invention relates to wiring elements suitable for use within doll houses and the like and which facilitate the connection of miniature fixtures within said doll house while simulataneously serving as a decorative part of the construction thereof.

2. Description of the Prior Art:

Miniature buildings have been widely used as toys and the like. Children have used these buildings along with electrical train and construction sets, etc. Doll houses are a particular example of this type of element. Doll houses have, however, exceeded the status of mere toys. Doll houses now form the basis of an extensive hobby system and many of those who collect and exhibit doll houses spend inordinate amounts of time and money insuring that the smallest detail of house and furniture construction is a correct and faithful reproduction of the regular size counterparts. These doll houses are then entered in contests to determine which of the entrants has produced the most authentic, overall house. Particular emphasis is placed on authentic reproduction of the furnishings and the attractiveness of the total effect. Some of the furnishings used within these doll houses are electrical in nature. These include a large variety of lamps and other lighting fixtures as well as simulated fireplaces, stoves and the like. Most of these fixtures are very expensive since they are exact reproduction of life-size elements. Considerable emphasis is given during the judging to the authenticity of these electrical elements. It is customary to use small, 12 volt bulbs in these fixtures to simulate the light output of, for example, 50 to 200 watt life-size light bulbs and the effect is very close to the original when viewed within the doll house. It is, however, very difficult to wire these elements into a convenient overall house system since the fixtures themselves are very small and the wiring is fine. Thus, it is desirable to provide a convenient wiring system that will not appear unsightly and detract from the desired appearance of the doll house during the judging. Several methods for wiring doll houses and the like have been suggested and used in the past. These include, for example, small, miniature outlets which simulate real wall plugs. These are very expensive to reproduce and take an inordinate amount of time to install within a conventional doll house. Another element suggested and used by the prior art is a wiring element based on a printed circuit board. Portions of conventional printed circuit boards are cut to fit along the wall portions of the various rooms in a doll house where desired. The copper portion of the printed circuit board is then etched in a conventional manner to leave two, small strips of copper running the length of the piece of circuit board. Then, holes are drilled through the board at various intervals and special plugs inserted therein. The lighting fixtures and other electrical elements are then connected to these special plugs. Wires are soldered on the end of each copper strip and these wires, interconnected to other circuit boards in other rooms, are finally connected to the appropriate electrical circuitry. This system is, to say the least, cumbersome and very expensive to use and install. The user must go through all the above steps which are time consuming and not at all related to the art field of miniature houses. Then too, special plugs must be used and these elements cannot be easily interchanged between fixtures. Finally, this method of wiring is unsightly and cannot easily be covered with furnishings, drapery, wall paper, paint and the like. Since those individuals participating in this hobby are particularly interested in having an attrative, finished end-product which can successfully compete in the judging described, the aforementioned wiring system for doll houses is totally unsatisfactory and its use is now almost non-existant.

Yet another method for providing suitable electrical wiring in miniature buildings and doll houses is simply to place the customary fine wiring about the various rooms and make connections to each electrical fixture or appliance and an appropriate connection made to an electrical source in each case. These wires are then "hidden" under the miniature carpets or behind the drapes. Alternatively, the wall paper is applied after the wiring step just mentioned in order to cover up the wires. The aforementioned system is also unsatisfactory since it is difficult to provide sufficient cover for all of the wires and the appearance and the decor of the doll house is thus affected. However, this system is considerably cheaper than the system which makes use of printed circuit boards as discussed above.

SUMMARY OF THE INVENTION

It is an object of this invention to provide a suitable means for the wiring of miniature buildings such as doll houses. A further object is to provide a miniature building wiring means which is an integral portion of the construction and decor of said miniature building and which will compare in detail with the larger, original counterpart. A still further object is to provide an easily concealable wiring means, said wiring means having means for connecting electrical component parts of said miniature building during the construction and furnishment thereof. Finally, it is an object of this invention to provide a miniature building which is neat in appearance and thus will will appear authentic in detail. These and other objects are achieved by providing a device for electrically wiring miniature buildings comprising (a) a miniature building construction component selected from the group consisting of baseboards, moulding strips, beams and wall paneling, said component having a rear side and a decorative, finished front facing, (b) at least two, closely spaced holes drilled through the component from the front facing to the rear side, each of said holes having a closely fitted metal cylinder inserted therein, and extending through said holes from the front facing to the rear side, (c) a first wire traversing the length of the rear side of the component and held in intimate contact therewith by connection to one of said metal cylinders, (d) a second wire in parallel relationship to said first wire and held in intimate contact with the rear side of said component by connection to another of said metal cylinders, so that when said wires are connected to an electrical source, current will pass through said wires and said metal cylinders from the rear side to the front facing of said component. These components can then be easily incorporated within the construction of the miniature building and provide a ready source of electricity for the various electrical fixtures, lights, appliances, etc. Since the wiring is incorporated within the various construction components, it is concealed from view and the overall appearance of the miniature building is vastly improved.

DETAILS OF THE INVENTION

Figure 1:
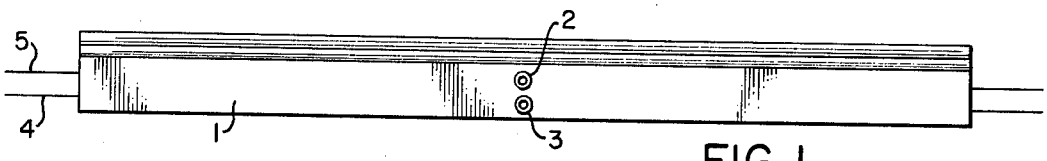
FIG. 1 is a front view of a wiring element of this invention.
Figure 2:
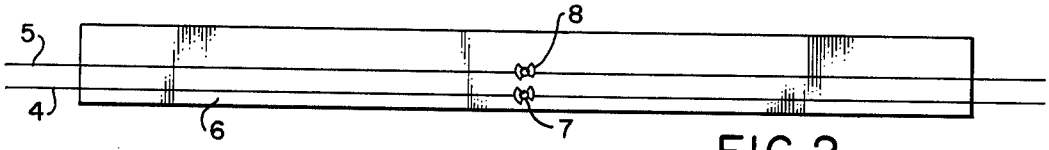
FIG. 2 is a rear view of the same wiring element of FIG. 1.
Figure 3:
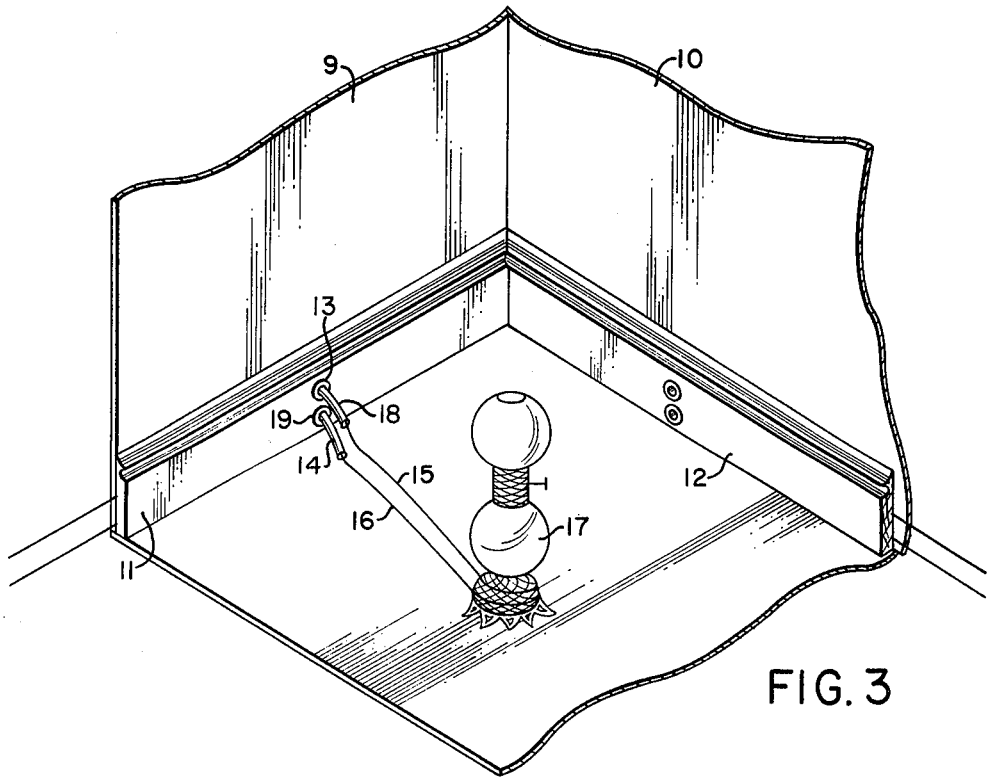
FIG. 3 is a view of a corner of a room of a miniature building having two wiring elements similar to FIG. 1 installed therein as baseboards.

Preferably, the wiring element of this invention will be a decorative baseboard construction component used in finishing the decorative portion of the miniature building. However, decorative moulding strips, wall board paneling, interior beams and the like can be used equally as well. These elements are all part of the finished construction within the various rooms of a miniature building (i.e. doll house) and thus are the most convenient to use in practising the concepts of this invention. The preferred mode is thus embodied in the drawings attached hereto. FIG. 1 is a frontal view of a typical baseboard which can be installed in a room of a doll house, for example. As shown in this drawing, (1) is the decorative front of the baseboard, (2) and (3) are the holes placed through the baseboard having metal cylinders inserted therein, and (4) and (5) are the ends of two parallel wires affixed to the rear side of the baseboard by connection to the rear portion of the metal cylinders. In this embodiment, the wires are shown extending beyond the actual length of the baseboard on both ends. This feature permits two or more baseboard elements to be interconnected within a particular room of the doll house by simply twisting the wires together to make contact in a conventional manner. It should be pointed out here that the baseboard element shown in FIG. 1 has a particular decorative design shown thereon. This design is not part of the invention and any of the conventional and well-known baseboard designs can be used equally as well. FIG. 2 is a rear view of the baseboard element of FIG. 1 with (6) being the non-decorative rear side, (7) and (8) are the rear portion of the holes showing the metal cylinders inserted therein, each end of the metal cylinders having been flattened in such a way so as to encompass wires (4) and (5) and hold said wires in close contact with the rear side of the baseboard. FIG. 3 shows the use of the baseboard embodiment of FIGS. 1 and 2 within the room of, for example, a miniature building such as a doll house. In this figure, (9) and (10) represent two walls forming a corner of a room. Two of the baseboard wiring elements representing the preferred embodiment of this invention are installed at the base of these walls and are shown as (11) and (12). A lamp (17) is shown connected to holes (13) and (19) through wires (15) and (16). Electrical connection is made between wires (15) and (16) and holes (13) and (19) by simply stripping insulation from a small portion of the end of each wire. This stripped portion is then bent over against small, plastic sleeves (14) and (18) which are placed over the wires to prevent the ends from fraying and to insure a snug fit of the wire ends in the respective holes. Connection then occurs between this uninsulated portion of the wires of the electrical fixture and the metal insert in each hole.

Preferably, eyelets are used to form the metal inserts for the holes. However, rivets or other form of snugly fitting metal cylinder can be used as well. Eyelets and rivets are preferred since they can be easily adapted to fit small holes, have a smooth front and have small, metal tabs that can be bent over to hold the metal insert snugly in the hole and to encapsulate a portion of the wire so as to hold the wire in close contact with the rear side of the component.

As mentioned previously, baseboard components are preferred. However, decorative wall board (e.g. wood paneling) can be used as well. One simply places the holes wherever desired, inserts eyelets or rivets therein and runs parallel wires on the rear side of the panel in a manner similar to that described for baseboards. The electrical outlets (in this case the "holes") can be located at the bottom of the panel to simulate floor outlets. Alternatively, these outlets may be located higher up for wall fixtures and the like. Decorative moulding strips in the corners of the rooms or at the top of walls can be used as well. For ceiling fixtures decorative beams are preferred. Decorative beams are also used in the walls to furnish additional decor and can be thus used as a wiring component in this manner also. Any building component which forms the finished portion of the rooms of the miniature building and which has flat surfaces can be used within the concept of this invention as known to those skilled in the art of miniature building construction.

To use the element of this invention within the miniature building so as to provide the wiring therefor, one simply installs the component within the room of the building in a normal manner. When more than one baseboard, panel, moulding strip or beam is to be used as a wiring element, it will be necessary to connect the wires between each element used in order to maintain electrical continuity. Of course, there may be other decorative elements without wiring attached thereto since no electrical connection may be needed in that portion of the room. As soon as all the necessary connections have been made, the last portion of the wiring is then connected to a suitable electrical source. In the case of doll houses, for example, this final connection is made to a transformer since it is customary to use 12 volt lighting fixtures therein. The transformer may be located outside the doll house or hidden within the attic portion of the house or some other convenient location as desired. The final connection is from the transformer to a regular electrical outlet (e.g. 110 volt house outlet) and the electrification of the doll house is complete.

In the drawings, a single pair of holes are shown in the baseboard element of this invention. This number was only selected to demonstrate the concept of the invention. Depending on the amount of electrification desired in that portion of the building in which the element of this invention is to be installed, several pairs of holes may be placed in the element. Preferably, about three pair are located in each of the wiring elements to be used. This will provide sufficient electrical outlets to wire the normal room arrangement in a doll house, for example.

Each of the building component parts used to make the electrical wiring element of this invention may be finished to match the building or room decor. Normally, the baseboard and moulding elements are painted. Wall panels and beams can be painted, left in a natural state or stained. Wall panels can also be papered to simulate wall paper.

The wiring elements of this invention present a neat, finished appearance and the wires are conviently hidden behind the decor. The connections between component parts can usually be hidden easily behind the part itself. When it is necessary to make a connection which cannot be contained behind the component part, these can be concealed with rugs, curtains, wall paper and other parts of the room decor. Since there are usually fewer of these connections, and many times none at all, they are easily hidden. Since the wires are parallel, there is no danger of accidental touching thus reducing the danger of fire caused from electrical sparks.

Figure 4:
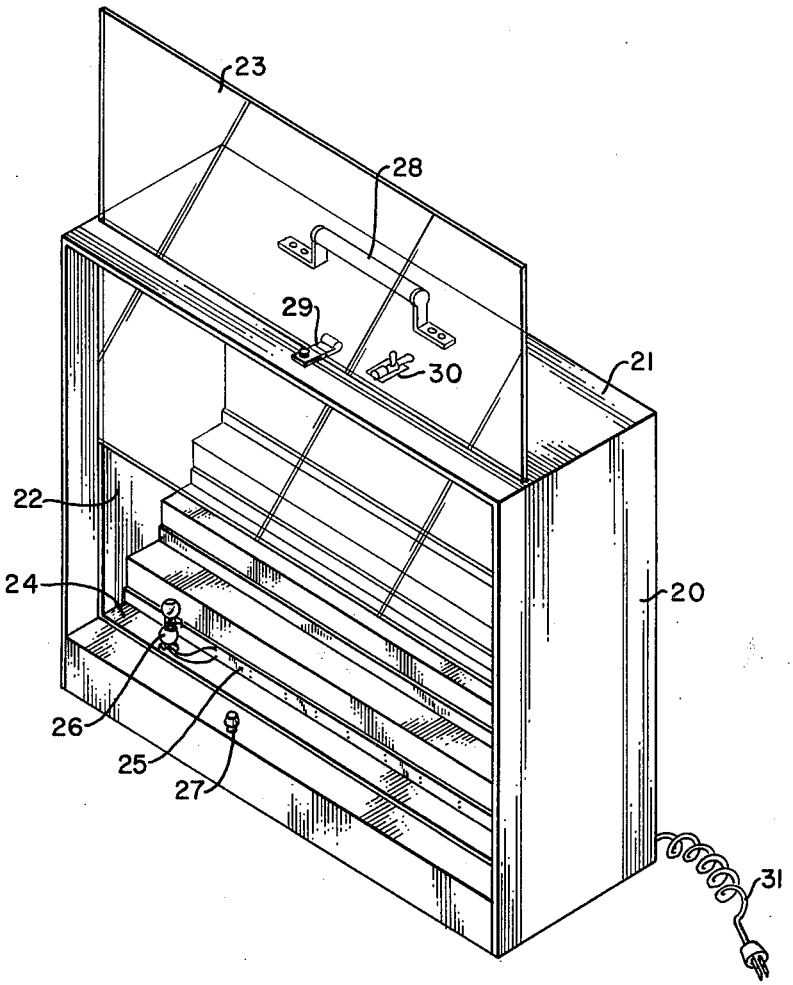
FIG. 4 is a special embodiment of this invention showing a case for use in displaying and exhibiting various electrical fixtures for use in miniature buildings and which employs the baseboard wiring element of FIG. 1 installed therein.

Another embodiment employing the elements of this invention is shown in FIG. 4. This embodiment is a "Dealer's Display Case" and is used by those who sell electrical fixtures in the market to display and show off the various fixtures to the customer. In this particular embodiment, the case has three solid sides shown as (20), (21) and (22) and a solid back and bottom (not shown). A clear, plastic sliding front (23) may be installed in the front portion of the case or box. In this particular instance, the plastic front is shown in a raised position. Several individual shelves for displaying the various types of electrical fixtures may be found within the case. The number of shelves would depend on the size of the case. Each shelf is then equipped with the baseboard element of this invention. One of the shelves in this drawing is shown as (24) and the baseboard wiring element as (25). A lamp (26) is shown connected thereto. Individual switches may also be installed within the case as desired. In this embodiment, a switch (27) is shown near the bottom shelf. The switches can be used to operate one or more of the wiring components so that the individual fixtures can be electrified for display purposes. A handle (28) may be installed on the top side to facilitate carrying of the case and locking devices (29) and (30) may also be included to keep the clear, plastic sliding front in place and for the security of the contents. The clear, plastic sliding front can be made to slide up and down in grooves made across the front of the display case. This feature allows easy access to the case interior and yet the front can be lowered and locked in place while transporting the case from place to place. The various wire connections are made underneath the shelves and the transformer, other switches, fuses and the like included therein. An electrical cord (31) is shown extending from the rear of the case. This cord is connected to a suitable electrical outlet to complete the case electrification. Finally, the shelves may be painted or wall papered to give the appearance of the interior of a doll house. Thus, the customer can view the electrical fixture within this context and make his selection based on this feature.

Alternatively, the display case can contain any of the building components previously described in this specification. The wall panels, strip moulding and beams may also be included so that the wiring system units demonstrated to the customer as well as the various electrical fixtures. Any number of fixtures, lighting elements, simulated fireplaces, etc., can be conveniently demonstrated within this display case.

The electrical wiring and connective elements provide a unique service in the construction and use of miniature buildings such as doll houses, in which they are particularly useful. The doll houses can thus be shown and judged for authenticity. The doll house may be composed of several rooms, each one furnished as desired by the builder. Sometimes, however, the doll house consists of a single room decorated in period furnishings. This invention can be used within that concept equally as well. The ability of the builder to electrically wire these rooms conveniently and without disturbing the room decor adds considerably to the authenticity of the display.

What is claimed is:

1. A device for electrically wiring miniature buildings comprising:
   (a) a miniature building component part selected from the group consisting of baseboards, moulding strips, beams and wall panels, said component part having a rear side and a decorative, front facing,
   (b) at least two, closely spaced holes placed through the component part from the front facing to the rear side, each of said holes having a closely fitted metal cylinder inserted therein and extending through said hole from the front facing to the rear side,
   (c) a first wire traversing the length of the rear side of the component part and held in intimate contact therewith by connection to one of said metal cylinders,
   (d) a second wire in parallel relationship to said first wire and held in intimate contact with the rear side of said component part by connection to another of said metal cylinders, so that when said wires are connected to an electrical source, current will be caused to pass through said wires and said metal cylinders from the rear side to the front facing of the component part.

2. The electrical wiring element of claim 1 wherein said metal cylinders are selected from the group consisting of rivets and eyelets.

3. The element of claim 2 wherein said metal cylinders are eyelets and said building component part is a miniature baseboard.

4. The element of claim 3 having a plurality of eyelets therein.

5. The element of claim 4 having a miniature electrical fixture attached thereto, said electrical fixture having 12 volt bulb therein.

6. The element of claim 5 wherein said miniature building is a doll house.

7. The doll house of claim 6 having a plurality of rooms therein and a plurality of baseboard wiring elements located in said rooms, each of said wiring elements being interconnected by a joining of the parallel wires.

8. The doll house of claim 7 wherein said parallel wires are further connected to an electrical source and an electrical current flows through said wires to said eyelets and said electrical fixture is illuminated.

* * * * *